US005823899A

United States Patent [19]

Goodge

[11] Patent Number: 5,823,899

[45] Date of Patent: Oct. 20, 1998

[54] GAMES RACKET FRAME

[75] Inventor: Graham Goodge, Suffolk, Great Britain

[73] Assignee: Dunlop Slazenger Group Limited, Surrey, England

[21] Appl. No.: 883,142

[22] Filed: Jun. 27, 1997

[30] Foreign Application Priority Data

Jul. 24, 1996 [GB] United Kingdom ..... 9615522

[51] Int. Cl.[6] ..... A63B 49/00

[52] U.S. Cl. ..... 473/540

[58] Field of Search ..... 473/524, 533, 473/540

[56] References Cited

U.S. PATENT DOCUMENTS

| | | | |
|---|---|---|---|
| 1,502,845 | 7/1924 | Blache | 476/540 |
| 4,049,269 | 9/1977 | Blackburne | 473/533 |
| 4,204,680 | 5/1980 | Blackburne | 473/533 |
| 4,320,900 | 3/1982 | Blackburne | 473/533 |
| 5,467,982 | 11/1995 | Tseng | 473/540 |

FOREIGN PATENT DOCUMENTS

| | | |
|---|---|---|
| 85211420 | 1/1982 | Taiwan . |
| 228650 | 2/1925 | United Kingdom . |
| 1021148 | 3/1966 | United Kingdom . |

*Primary Examiner*—William E. Stoll
*Attorney, Agent, or Firm*—Lorusso & Loud

[57] ABSTRACT

A games racket frame comprising a head portion defining a string bed of main strings and cross strings, a shaft portion and a handle portion wherein at the crown of the head portion a cross-section through the head portion perpendicular to the string bed reduces in width towards the string bed, and the main strings wrap around the head instead of passing through drilled string holes. The invention has the potential advantages of improving breakage resistance properties and allowing a player to play close to the wall shots.

13 Claims, 3 Drawing Sheets

GAMES RACKET FRAME

BACKGROUND OF THE INVENTION

1. Field of the Invention

This invention relates to a novel games racket frame, and particularly to a squash racket frame.

2. Description of the Prior Art

Conventional squash rackets comprise a head portion for stringing, a shaft portion and a handle portion, the head consisting of a hollow tube e.g. made from fibre reinforced epoxy resin. The head is drilled so that main-strings and cross-strings can be passed through the resulting string holes.

A disadvantage with this construction is that the string holes constitute a weakness in the head, particularly with the main-string holes at the crown of the head where contact with the wall of a court is more likely to occur. This is particularly true where the racket is designed to be very lightweight and thus has very thin walls in the head portion.

A further disadvantage of conventional squash rackets is that for close to the wall shots a significant thickness of the head portion, parallel to the strung area, intervenes between the wall and the strung area when the racket contacts the wall. This constitutes a "dead" area which cannot be used to strike the ball effectively.

SUMMARY OF THE INVENTION

It is possible to overcome these disadvantages by means of the present invention in which a games racket comprises a head portion defining a string bed of main-and cross-strings, a shaft portion and a handle portion wherein at the crown of the head portion (i) a cross-section through the head portion perpendicular to the string bed reduces in width towards the string bed and (ii) the main-strings wrap around the head and (iii) there are substantially no drilled string holes at the crown.

Potential advantages resulting from the present invention are i) an improvement in the breakage resistant properties of the racket resulting from accidental contact with the wall of a squash court; and (ii) an improvement in the ability of a player using the racket to play close to the wall shots.

The cross-section of the crown region may taper towards the string bed, for example it may have a tear-drop or triangular configuration. Alternatively the cross-section may have a T-shape or pear shape. The objective is that the effective thickness of the frame being the distance between the point where the strings contact the frame and the point of contact with the court wall is reduced to a minimum. Of course, the frame must still be sufficiently stiff and strong to withstand the stresses encountered during play.

In a preferred embodiment the head portion is designed so that main-and cross-strings all pass through holes therein except for the main-strings in the crown region which wrap around the head portion. To facilitate this the cross-section of the head portion in the crown region differs from that of the remainder, in that the thickness of the frame perpendicular to the string bed reduces and the thickness of the frame parallel to the string bed increases in the crown region as compared to the remainder of the head portion. Thus the major axis of the cross-section rotates by 90° in passing from the crown region to the remainder of the head portion. Preferably the reduction and increase are achieved by tapering rather than by an abrupt change.

Conventionally, the frame for a squash racket is made by wrapping sheets of resin-impregnated fabric around an inflation tube which is subsequently moulded by expanding it within a heated mould to the desired shape of the racket. To facilitate this moulding technique and according to a further embodiment of the present invention the circumference of any section through the head portion perpendicular to the plane of the strings is substantially the same, even though the cross-section may vary in shape.

In the crown region where the main-strings wrap around the head portion, preferably location means is provided for locating the strings and holding them in position. This location means may also protect the strings from abrasion against the court wall. Examples of suitable location means are grooves moulded into the surface of the head portion or separately moulded saddle portions which are fitted onto the head portion.

The length of the head portion at the crown which does not have string holes and around which main-strings wrap around is preferably between 20% and 40% of the total circumference of the head portion, more preferably between 25% and 35%.

BRIEF DESCRIPTION OF THE DRAWINGS

An embodiment of the present invention will now be described by way of example only with reference to the drawings in which:

FIG. 1(*b*) is a section through the crown of the conventional squash racket of FIG. 1(*a*);

FIG. 2(*b*) is a section through the crown of the novel squash racket of FIG. 2(*a*);

Referring to FIG. 1(*a*), this shows a conventional squash racket where the main-and cross-strings pass through the head portion. FIG. 1(*b*) shows a cross-section of the crown (1) of a conventional squash racket in contact with a court wall (2). Main-strings (3) interlace with cross-strings (4) and pass through the crown (1). Distance (5) between court wall (2) and main-strings (3) constitutes a "dead" area which cannot be used to strike a ball effectively.

Referring to FIG. 2(*a*), this shows a novel squash racket according to the present invention in which main-strings (6) wrap around the crown (7). FIG. 2(*b*) shows a cross-section of the crown (7) of the racket shown in FIG. 2(*a*) which is pear shaped and provided with grooves (8) moulded into the crown (7) over which the main-strings (6) wrap and are held in place by the side walls defining the grooves (8). Distance (9) between the court wall (10) and main-strings (6) constitute a "dead" area which is smaller than that (5) resulting from the conventional racket of FIG. 1(*b*).

Referring to FIG. 3, this is cut away to show the tear drop shaped cross-section of the crown (11), the axis (12) being the major axis in the crown and the axis (13) being the major axis outside the crown. Thus the major axis (13) rotates by 90° as it enters the crown (11) to result in the major axis (12).

Referring to FIG. 4, main-strings (14) wrap around the crown (15) and are held in place by means of saddles which are fitted onto the crown (16). Again, the cross-section of the crown (15) is tear-drop shaped (17).

Referring to FIG. 5, the main-string (14) subtends an angle (X) with the plane of the string bed (18). The size of this angle (X) depends upon the thickness of the crown (19) and the position of the first interlaced cross-string (20). Preferably this angle (X) is as small as possible (e.g. 5° to 15°) consistent with the strength and stiffness considerations of the frame in this region and appropriate positioning of the first cross-string.

Figure 1A:
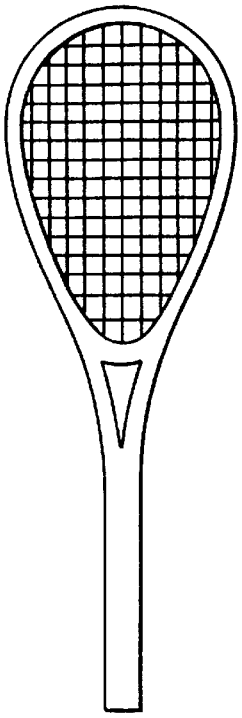
Fig. 1(a) PRIOR ART
FIG. 1(*a*) is a front view of a conventional squash racket.
Figure 2A:
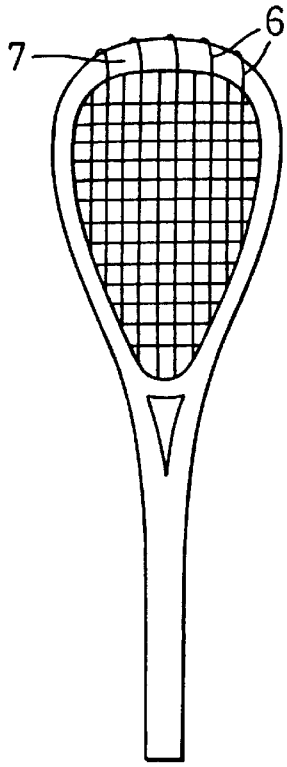
FIG. 2(*a*) is a front view of a novel squash racket.
Figure 1B:
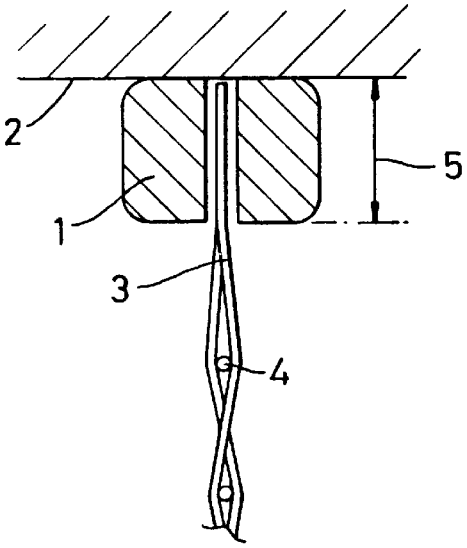
Fig. 1(b) PRIOR ART
Figure 2B:
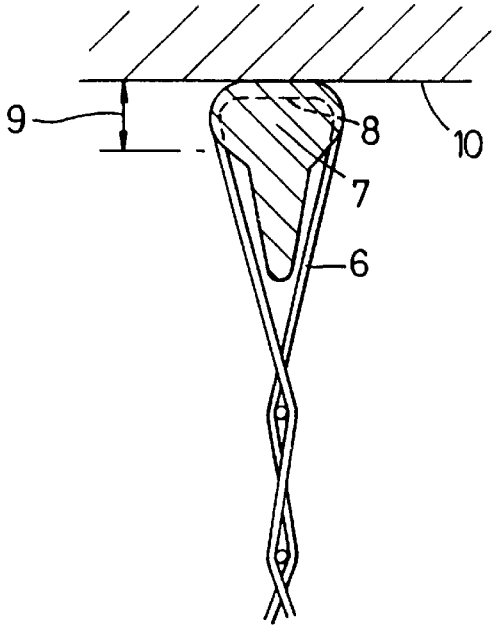
Figure 3:
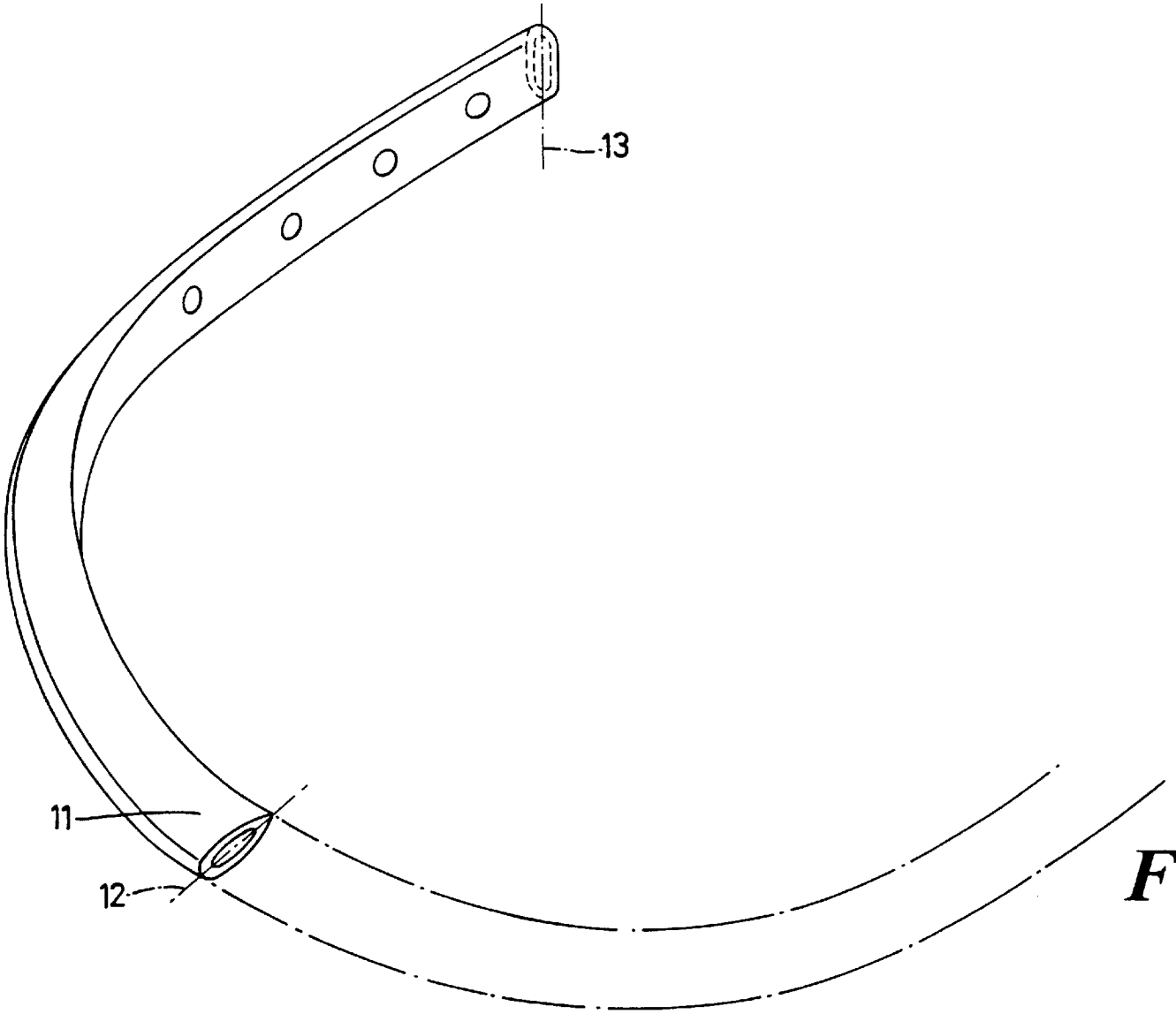
FIG. 3 is a perspective view of part of a novel squash racket, cut away to show cross-section.
Figure 4:
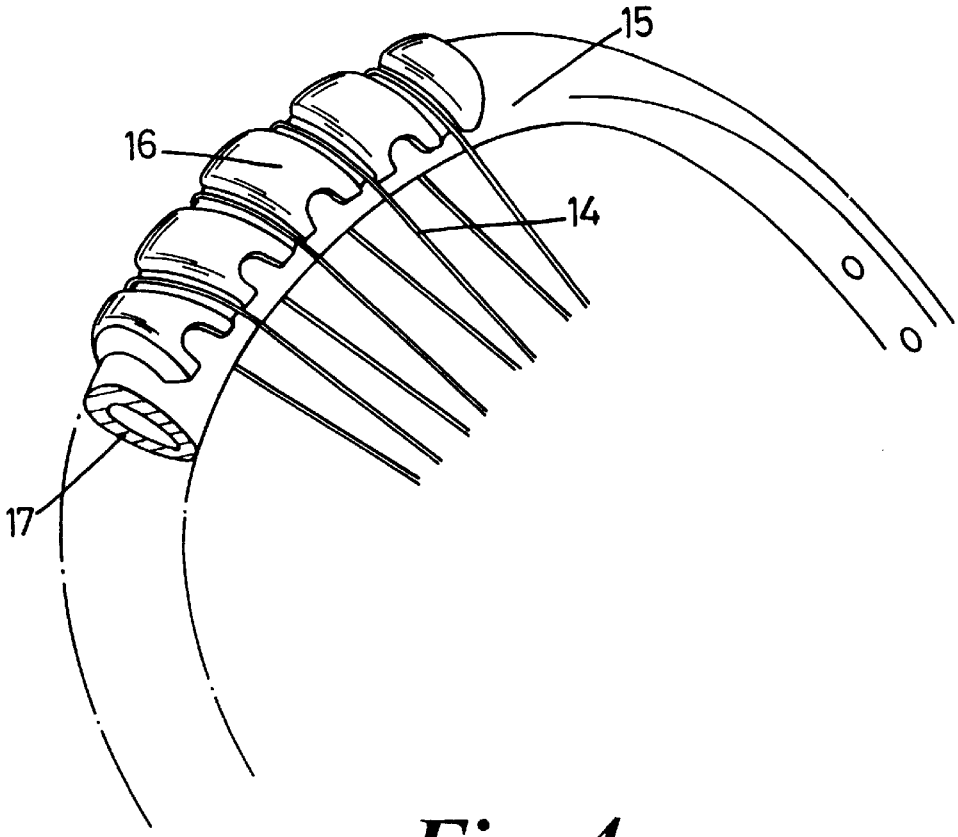
FIG. 4 is a perspective view of part of a novel squash racket.
Figure 5:
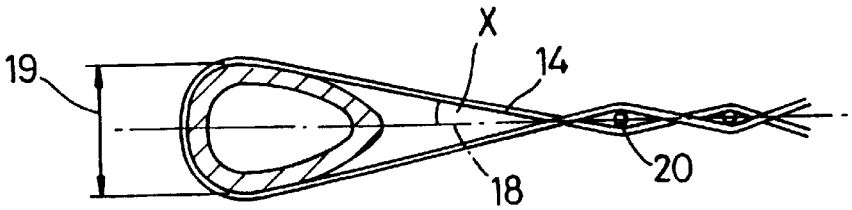
FIG. 5 is a cross-section of the crown of the novel squash racket shown in FIG. 4.

I claim:

1. A games racket comprising a head portion defining a string bed of main strings and cross strings, a shaft portion and a handle portion, the head portion defining a crown remote from the shaft portion, wherein (i) at the crown a cross-section through the head portion perpendicular to the string bed reduces in width towards the string bed;

(ii) at the crown the main strings wrap around the head instead of passing through drilled string holes; and (iii) the major axis of a cross-section in the crown is generally parallel to the string bed and the major axis of a cross-section in other parts of the head portion is generally perpendicular to the string bed.

2. A games racket according to claim 1 wherein the cross-section at the crown of the head portion is tear-drop shaped.

3. A games racket according to claim 1 wherein the cross-section at the crown of the head portion is pear shaped.

4. A games racket according to claim 1 wherein the cross-section at the crown of the head portion has a T shape.

5. A games racket according to claim 1 wherein the crown extends between 20% and 40% of the total circumference of the head portion in the plane of the string bed.

6. A games racket according to claim 5 wherein the crown extends between 25% and 35% of the total circumference of the head portion.

7. A games racket frame according to claim 1 wherein the crown is symmetrical about an axis through the handle portion of the games racket.

8. A games racket according to claim 1 wherein the major axis of a cross-section in the crown region is substantially parallel to the string bed and the major axis of a cross-section in substantially the remainder of the head portion is perpendicular to the string bed.

9. A games racket according to claim 1 wherein in the crown region location means is provided to locate the main-strings and hold them in position.

10. A games racket according to claim 9 wherein said location means comprises grooves moulded into the surface of the head portion.

11. A games racket according to claim 9 wherein said location means comprises separate saddle portions fitted onto the head portion.

12. A games racket according to claim 1 wherein the angles subtended by the main-strings in the crown and the plane of the string bed are between 5° and 15°.

13. A games racket according to claim 1, wherein the main strings are interwoven with the cross strings to form a single plane of intermeshed strings.

* * * * *